US005108537A

United States Patent [19]

Garnes et al.

[11] Patent Number: 5,108,537

[45] Date of Patent: Apr. 28, 1992

[54] APPARATUS FOR APPLYING WRAP-AROUND LABELS TO CONTAINERS

[75] Inventors: Richard H. Garnes; Frank J. DiFrank, both of Toledo, Ohio

[73] Assignee: Owens-Brockway Glass Container Inc., Toledo, Ohio

[21] Appl. No.: 610,474

[22] Filed: Nov. 6, 1990

[51] Int. Cl.[5] ..... B65C 3/00

[52] U.S. Cl. ..... 156/447; 156/86; 156/215; 156/486; 156/521; 156/583.1

[58] Field of Search ..... 156/218, 84, 86, 212, 156/451, 453, 447, 521, 215, 486, 583.1, 583.7; 53/556, 557; 413/26, 30

[56] References Cited

U.S. PATENT DOCUMENTS 4,310,369 1/1982 Miller et al. ..... 156/218
4,832,774 5/1989 DiFrank et al. ..... 156/566 X
4,851,072 7/1989 Kontz ..... 156/453

*Primary Examiner*—David A. Simmons
*Assistant Examiner*—James J. Engel, Jr.

[57] ABSTRACT

Apparatus for applying wrap-around labels to containers, such as bottles, where the label is wrapped around the container and a vertical heat seal seam is formed as the containers are moved in a linear path on a conveyor. The containers are held in engagement with the conveyor surface with one side of the containers being beyond the edge of the conveyor on the side where heat seal bars are brought into contact with the overlap to form a heat sealed seam. The containers are also held down against the conveyor during the period of movement of the containers to the exit end of the conveyor.

2 Claims, 6 Drawing Sheets

APPARATUS FOR APPLYING WRAP-AROUND LABELS TO CONTAINERS

BACKGROUND OF THE INVENTION

It has become generally accepted in the trade that containers which contain beverage and food products will have a label thereon. Many different systems are presently used to apply the labels to the containers. Some of these systems will apply the label to the container after it has been filled and sealed. Other systems utilize the prelabeled container which is then filled with the product and sealed before distribution.

The present invention is most closely associated with the systems that prelabel the containers before they are filled with a product.

Prior art systems which prelabel containers are known, and one such system which has received considerable acceptance is that disclosed in U.S. Pat. No. 3,802,942, issued to Amberg et al and assigned to the Assignee of the present application. This patent teaches the forming of labels from heat shrinkable plastic that is formed of a film-foam combination plastic that is fed in an oriented sheet form to a vacuum transfer head. The labels are preprinted and cut into lengths as they are received on the transfer head which then delivers the individual labels to a plural sleeve on a mandrel and forms a seam where the ends overlap. Containers are simultaneously processed by being preheated and indexed over the sleeve supporting mandrels. The sleeves are telescopically assembled on the containers and then, together, are transported through a heat shrink tunnel. The plastic sleeve shrinks into snug surface fit with respect to the container.

As can be seen by reading the foregoing U.S. Pat. and U.S. Pat. No. 3,767,496, issued Oct. 23, 1973, which discloses the overall process that the apparatus of U.S. Pat. No. 3,802,942 will perform, the forming of a tightly conforming, heat shrunk label on a container, such as a glass bottle, is not a simple task. To prevent wrinkling of the label and consequent distortion in the graphics of the label, it is necessary to apply the label to the bottle in a careful manner. The ends of the label must come into registry so that the label will not seem to be askew. When the label is to be a heat-shrinkable plastic, the ends have to overlap and be firmly sealed together to form a seam that will withstand the stress that is produced when the label shrinks.

When it seemed desirable to make the labeled container without having the label formed into a seamed sleeve before applying it to the containers, systems were designed to use the bottle or container itself as the mandrel and then wind the label about the bottle and seal the overlapped ends. This system has been disclosed in several recent U.S. patents, including U.S. Pat. No. 4,574,020, issued Mar. 4, 1986, to H. R. Fosnaught and assigned to the Assignee of the present case.

In a still more recent U.S. Pat. No. 4,832,774, issued May 23, 1989, of common Assignee and inventorship with the present application, a system of labeling bottles is disclosed where a label is held by a vacuum head which advances into opposing relationship with a linearly moving bottle. In a timed sequence, the label has its ends pushed about the bottle until they become overlapped, at which time a heater bar engages the overlap to heat seal the label ends together. The bottle with surrounding label is then passed through a heat zone to shrink the label into external conformity with the bottle.

One problem that has arisen with the operation of the abovedescribed apparatus under U.S. Pat. No. 4,832,774 has been the tendency of the overlapped ends of the labels to move out of vertical registry when the machine is operated at high speeds. While a perfectly good label is produced most of the time, the out-of-registry of the overlapping ends can produce a label that does not have a perfect appearance and thus does detract from the aesthetics of the label. This may occur when operating at increased labeling speeds.

In solving the problem stated above, a system was devised which uses vacuum heads to engage the ends of the labels to give a more positive control over the end while being moved about the containers into overlapping relationship, at which time the overlap is heat sealed, while the containers and labels are moving in a generally linear path. This system is disclosed in a commonly assigned U.S. patent application Ser. No. 454,486 of which the present invention is an improvement thereover.

SUMMARY OF THE INVENTION

It is an object of the present invention to provide a tubular label with a heat sealed seam applied to the container where the labels are cut and moved, in series into alignment with a line of moving containers. The ends of the label are applied about the container so that their ends overlap, with an electrically heated bar engaging the overlap with the bar formed to have a constant heat output throughout the length of the overlapped label ends to form a heat seal. During the latter portion of the period of heat sealing of the label ends and the movement of the exiting of the containers from the applicating unit they are held down against the moving surface of a conveyor that carries the containers to an entrance to a heat shrink tunnel.

The exiting containers are brought to a speed which matches the speed of a conveyor that moves the containers through the heat shrink tunnel.

Other and further objects will be apparent from the following description taken in conjunction with the annexed sheets of drawings.

DETAILED DESCRIPTION OF THE PREFERRED EMBODIMENT

Figure 1:
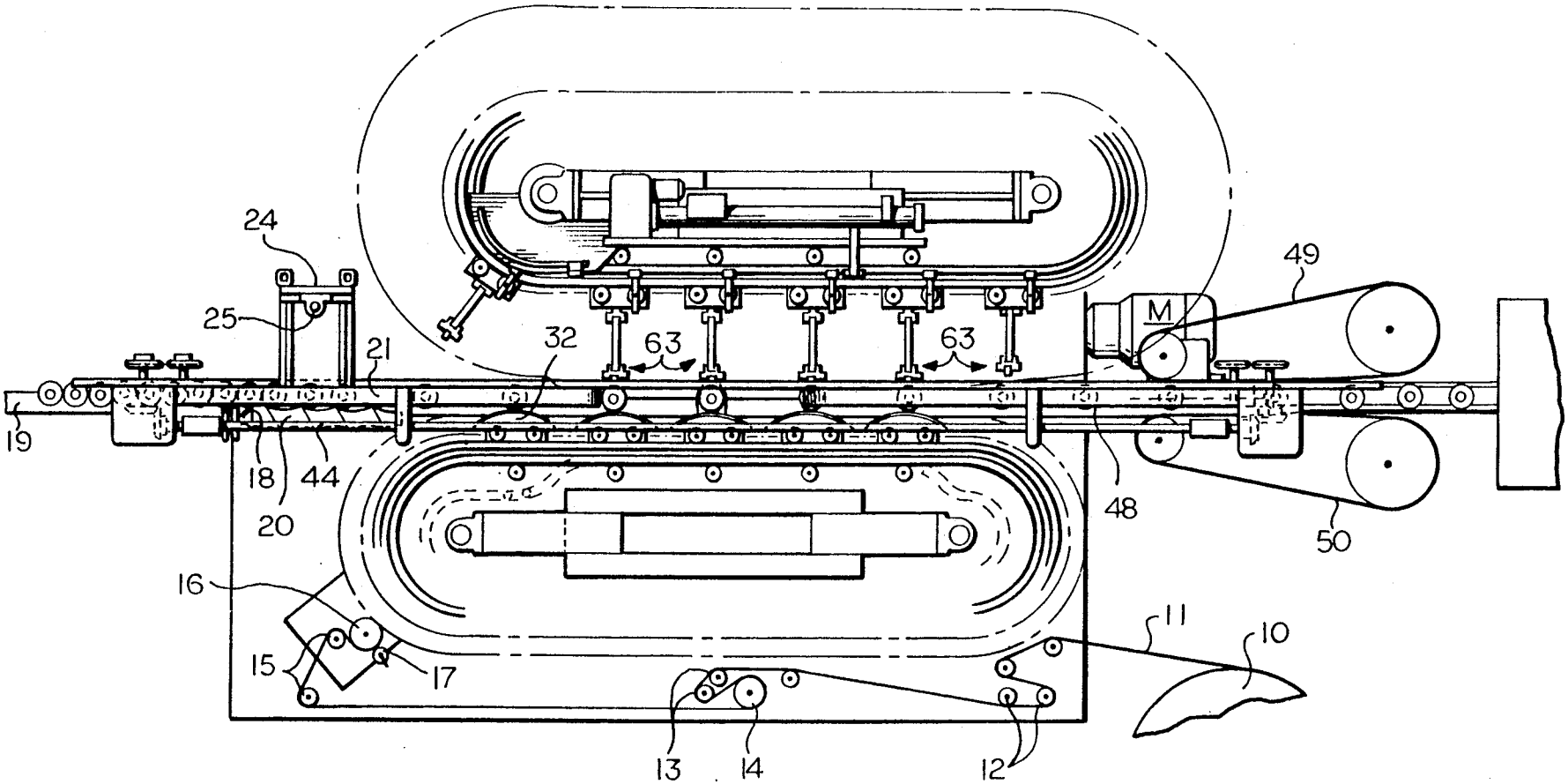
FIG. 1 is a top plan view of the apparatus of the invention.
Figure 2:
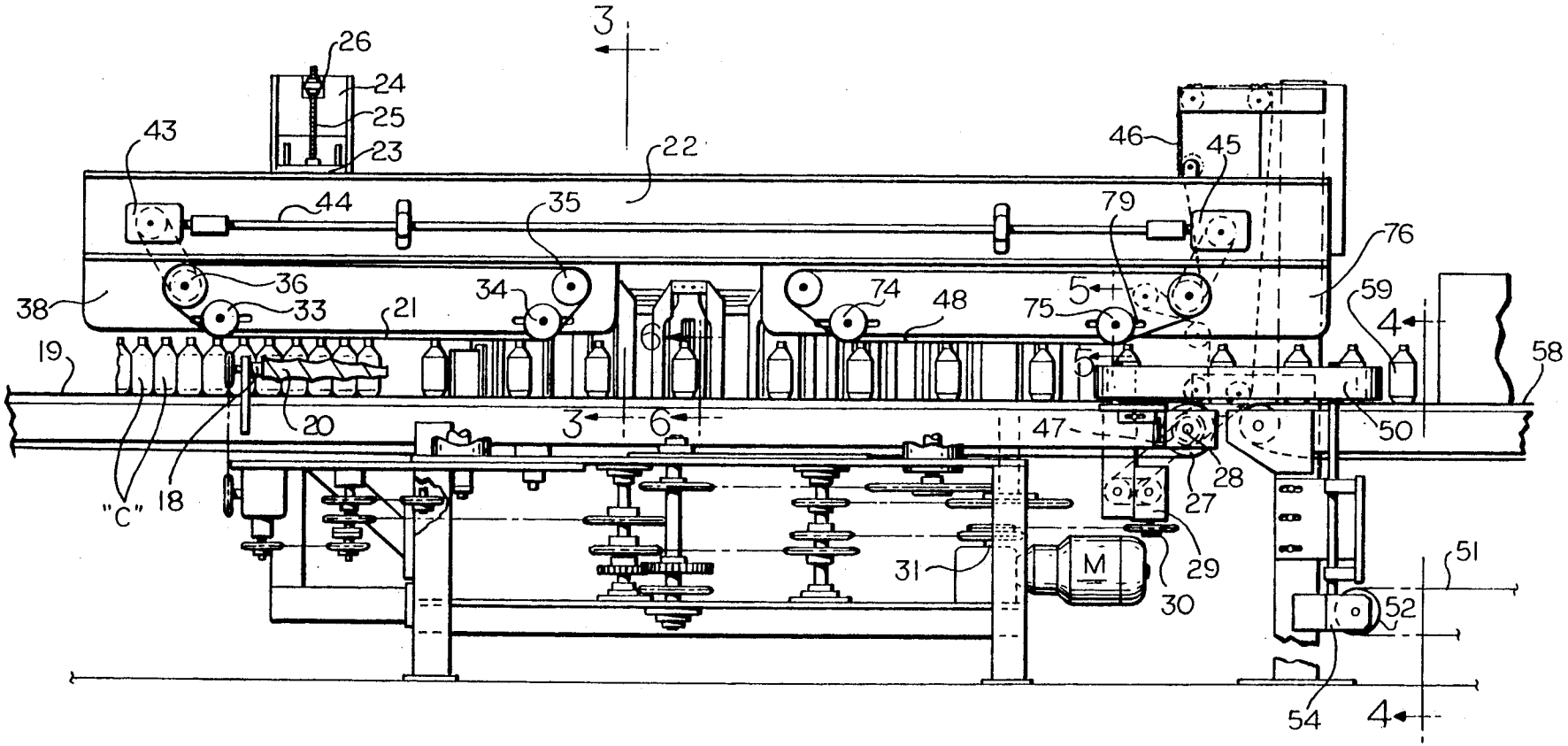
FIG. 2 is a schematic, side elevational view of FIG. 1, taken with the mechanism above the conveyor removed on the near side, except the exit portion.

The present invention relates to the forming of thermoplastic sleeve labels about the circumference of containers, such as glass bottles, where the labels come in a strip and are severed into label lengths before being applied to the bottle. As best shown in FIGS. 1 and 2, the labels come in a large roll 10 which is supported (not shown) for rotation about a vertical axis. The strip 11 of label material is threaded about a set of guide rollers 12. Another set of guide rollers 13 receive the strip or web of labels and serve to guide the strip about a first drive roll 14. An additional pair of idler rolls 15 serve to guide the web into contact with a vertical roll 16 which serves to transport the loading end of the label strip past a rotating knife 17 that will cut the strip at the precise length of the individual label.

Figure 3:
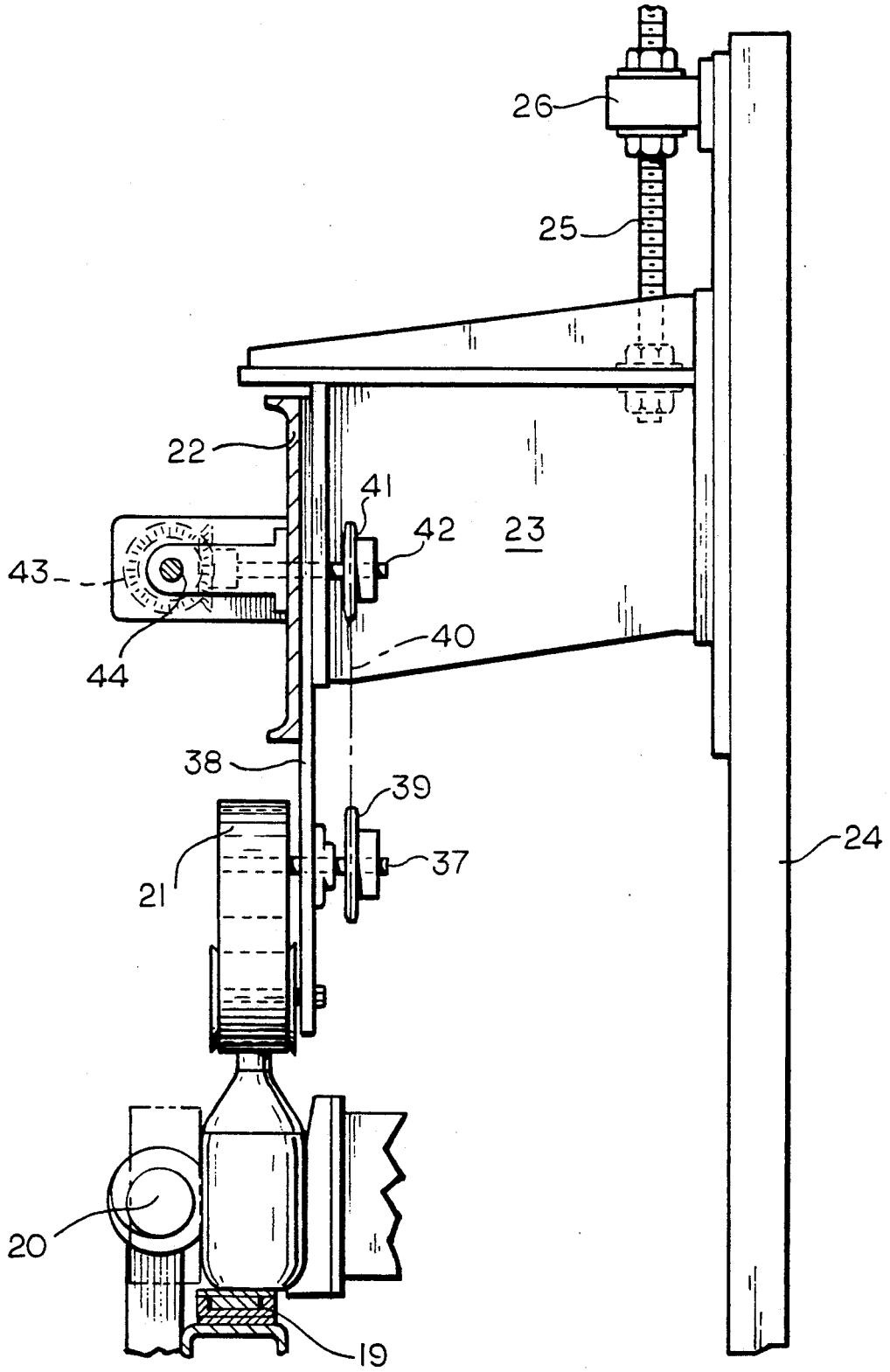
FIG. 3 is a cross-sectional view on an enlarged scale, taken at line 3—3 of FIG. 2.
Figure 4:
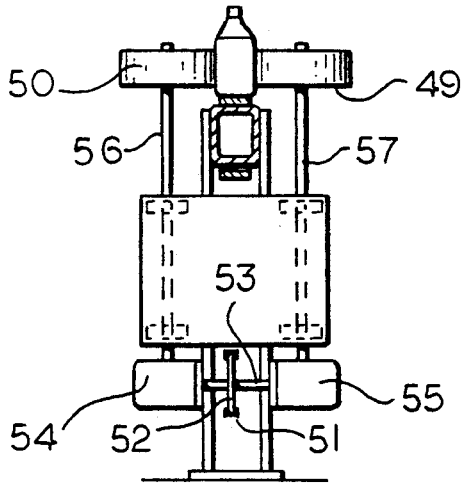
FIG. 4 is a cross-sectional view taken at line 4—4 of FIG. 2.

Reference may be had to the detailed description in the specification of U.S. Pat. No. 4,832,774 and U.S. application Ser. No. 454,486, filed Dec. 21, 1989, for the details of the system for driving the mechanisms that make up the main portion of the apparatus. For example, the motor M through a series of sprockets, chains and vertical shafts will drive the drum 16, drive roll 14, knife roll 17 and a horizontal shaft 18 that extends generally parallel to an infeed conveyor 19. The shaft 18 carries a timing worm 20 that extends along one side of the conveyor 19 at a height that is generally even with the sidewall of a container "C" that is resting on the upper surface of the conveyor. The conveyor is driven in a left to right direction, as viewed in FIGS. 1 and 2, and as the containers approach the inlet end of the worm 19, they will be contacted from above by a driven endless belt 21 that is supported from a generally horizontal beam 22. The beam 22 extends the full length of the labeling machine. As shown in FIG. 3, the beam 22 has its forward end connected to a horizontal, reinforced arm 23 that is slidably received in a vertical mounting beam 24. The arm 23 carries a vertically extending threaded bolt 25 that extends through a horizontal mounting bracket 26 that is fixed to the beam 24. The threading of the bolt through the nuts on either side of the bracket 26 will affect the height of the beam 22 relative to the conveyor 19. This adjustment is for the purpose of setting the height of the lower run of the belt 21 to accommodate bottles of different heights.

The belt 21 functions to hold the bottles down against the surface of the moving conveyor belt that extends beyond the left end of the machine and extends to the right around a drive pulley or sprocket 27. The pulley 27 is mounted on a shaft 28 supported at the right end of the machine and may be chain driven by the output shaft of a gear box 29. The gear box 29 has an input shaft 30 that is connected by a sprocket and chain drive to the output shaft 31 of the motor M.

The containers "C" will enter from the left on the conveyor and be engaged by the worm 20 which will space the containers apart a specific distance. As the containers move past the worm into position to be engaged by the arcuate shaped, label supporting vacuum head 32 they will be held down by the overhead belt 21 which is guided by three idler rolls 33, 34, 35 and a drive roll 36. The drive roll 36 is supported by a shaft 37 which extends through a bearing mounted to a beam extension plate 38 supported by the beam 22. A sprocket 39 on the shaft 37 is driven by a chain 40 from a drive sprocket 41 mounted on a shaft 42. The shaft 42 is driven from a set of beveled gears 43 connected to a main drive shaft 44. The shaft 44 extends to the other end of the beam 22 where a gear box 45, similar to gears 43, is located. The gear box 45 is driven by a chain 46 that is driven by the motor M through a sprocket 47 mounted on the shaft 28. The chain 46 passes through a series of idler sprockets for the purpose of taking up any slack that might develop.

While the beam 22 is shown supported from a vertical beam at the left end only, it should be understood that the right hand end of the beam is similarly supported for vertical adjustment, although this is not shown in the drawings.

The right hand end of the beam 22 also supports an overhead belt 48. The belt 48 functions to hold the containers steady during the exit movement from the label applicating machine and therefore it is in contact with the container finish until the container is engaged by a pair of side engaging belts 49 and 50. The belts 49 and 50 are driven by a motor (not shown) through a chain 51 and sprocket 52. The sprocket 52 is mounted to drive input shaft 53 of a pair of gear boxes 54, 55. Both gear boxes 54, 55 have a vertical output shaft 56, 57 that extend up to the drive pulleys for the belts 50, 49. The motor that drives the chain 51 also drive the conveyor 58 that transports the labeled containers 59 through a heat shrink oven 60. It is important that the containers which are labeled be moved through the heat shrink tunnel at fairly precise intervals so that the heat shrinkage is uniform and not inconsistent. If the conveyor 58 were to stop, the container labels might burn or become overheated, and by the same token, if they are not spaced apart at regular intervals, the heat characteristics of the tunnel would not be uniform for all the containers. This is the reason that it is important for the exit belts 49 and 50 be under the speed control of the shrink oven 50 and its conveyor 58. The containers are under positive control from the time they leave the infeed worm until they are exited by the belts 49, 50. This control is by the overhead belts 21 and 48 at either end of their travel. During the mid portion of their travel, the containers are engaged by the wrapping arms as disclosed in U.S. patent application Ser. No. 454,486, an improvement over U.S. Pat. No. 4,832,774.

Figure 7:
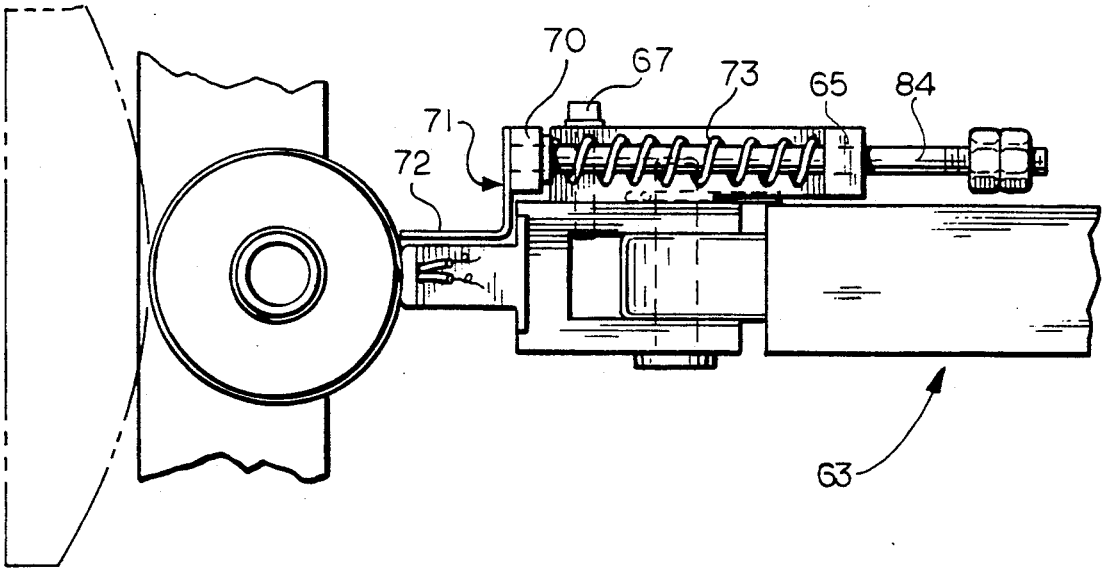
FIG. 7 is a top view of the sealing head of FIG. 5.
Figure 8:
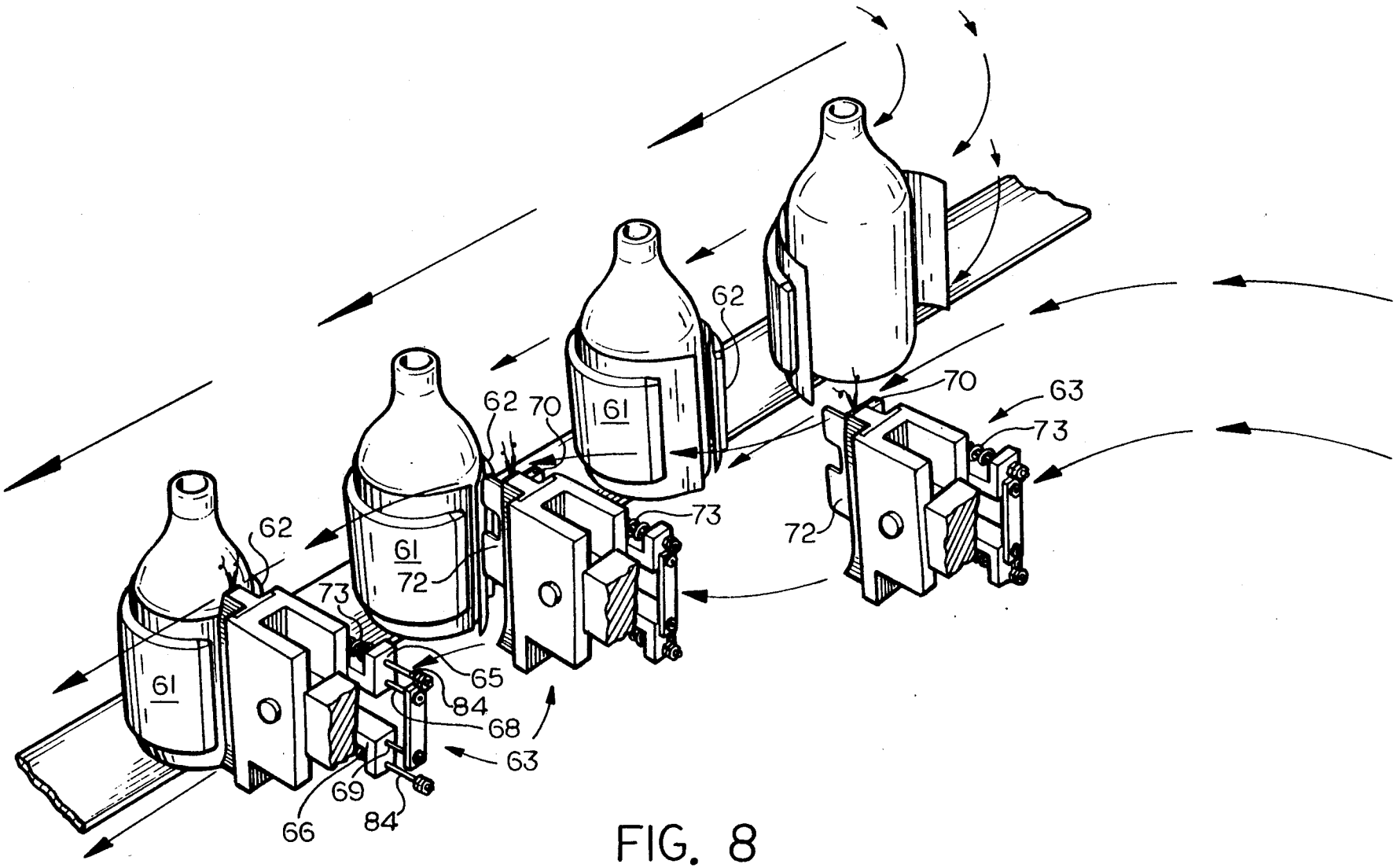
FIG. 8 is a schematic perspective view illustrating the sequence of movement of the bottles, labels and sealing heads during the operation of the apparatus of the invention.

When arms 61 and 62 that apply the labels, as schematically illustrated in FIG. 8, and engage the ends of the label, the arm 61 first engages and moves its end of the label about the container into fairly close proximity to the container wall and the trailing arm 62 will move the trailing end of the label into generally overlapping relationship to the leading end of the label. When viewing FIG. 7, the sequence is of the container moving from right to left on the conveyor 19.

Figure 6:
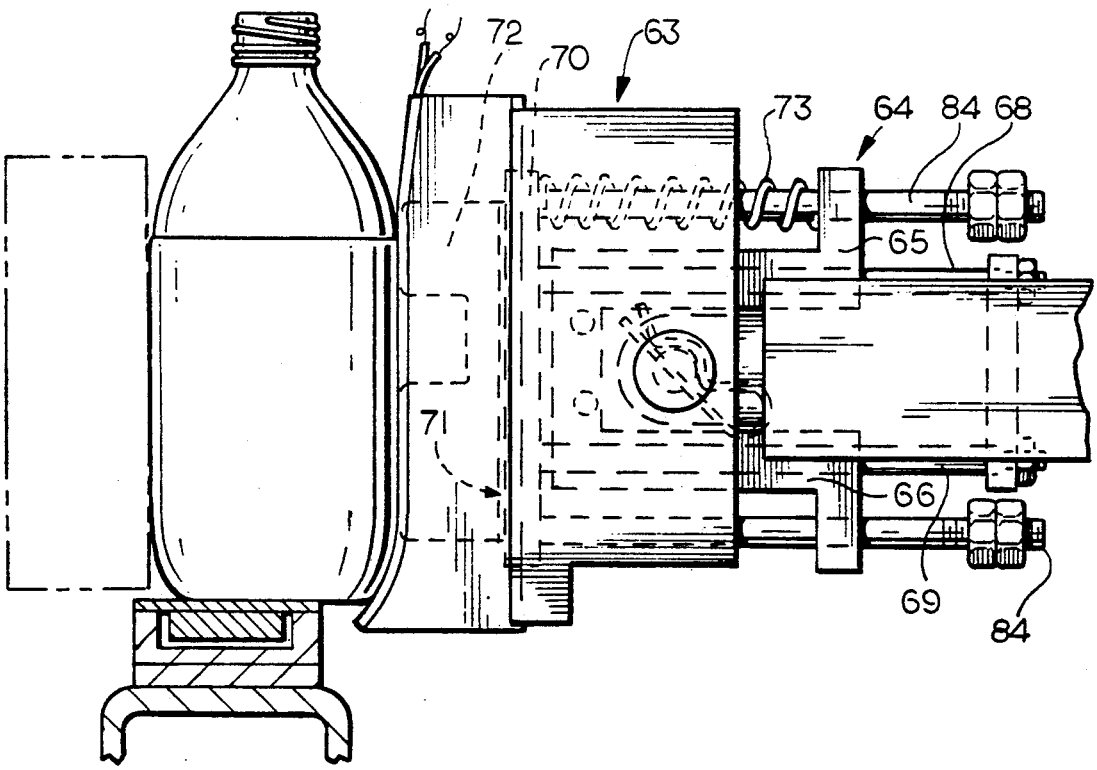
FIG. 6 is a cross-sectional view on an enlarged scale taken at line 6—6 of FIG. 2 showing the heat sealing head.

It should be kept in mind that the bottom of the container does not sit on the center of the conveyor, but actually has a portion extending off the side of the conveyor that passes in front of a series of heat seal heads or bars 63 (see FIG. 3). These bars 63 are mechanically reciprocated by the mechanism fully illustrated and described in U.S. Pat. No. 4,832,774. The heat seal heads 63 generally consist of an electrical resistance heater strip or tape applied over a contoured rubber member. The tape surface is covered with a protective coating such as Teflon, as set forth in U.S. Pat. No. 4,832,774. One problem that has been experienced with the heat seal head of the above patent was that on some occasions the head would move to form the overlap with the two ends of the labels slightly out of position and they would be bent in the wrong direction resulting in an unacceptable seal. The problem would most often occur when the apparatus was operating at a fairly high speed. To obviate this problem, and as shown in FIGS. 6, 7 and 8, the improved head 63 is provided with U-shaped yoke 64 fastened at 67 to its side with the arms 65, 66 of the "U" extending horizontally. A pair of guide pins 68, 69 extend through passages in the arms and support a vertical bar 70 that is generally parallel to the bottom of the yoke 64. The bar 70 has a right angle plate 71 fixed to its face opposite the pins 68, 69. The plate 71 forms a vertical finger like member or portion 72 that will extend beyond the sealing end of the head 63. The plate 71 is biased in the direction of the container by coil springs 73 that extend between the yoke 64 and bar 70. The springs are guided and held in place by guide bolts 84. The nuts on the ends of the bolts 84 are for the purpose of limiting the extent of movements of the bar 70 and finger 72 to the left in FIGS. 6–8.

When the sealing head 63 is actuated to engage the overlapped ends of the label, the finger 72 will engage the end of the label and guide it into position so that the heat bar 63 will always contact the overlap of the label ends and therefore apply the heat to the exterior of the outside surface of the trailing end of the label.

Another problem that may occur at high speed operation is the inability to maintain a uniform heat output for the heat seal bar. One reason is that the resistance heater, if fairly uniform from top to bottom, will heat the heat sink member, but the upper and lower ends being exposed to the atmosphere would dissipate the heat more quickly than the middle of the bar. This could result in the ends not becoming fully heat sealed and, upon shrinking, the label would open up at the ends. One way to insure that sufficient heat would be applied was to turn up the power to the resistance. This, however, could result in the central area of the heat seal bar burning the label seam. To correct this problem, the length of the heat seal bar was increased so that the bottom of the bar extends below the conveyor belt. The heater element in the bar extends down to a point below the bottom of the container, thus, in effect, resulting in a more uniform temperature for the entire portion of the bar that actually engages the overlapped ends of the label. The ideal situation is where the heat is uniform throughout the seal area so that there would not be any hot spots or unsealed areas. The resistance wire pattern in the heater can be made non-uniform to compensate for the natural tendency for the ends to be cooler. As one would expect, the speed of the machine will dictate the actual temperature of the heater bar since the sealing of the label ends is a time-temperature dependent operation. The use of specially designed heater elements to compensate for heat loss in the ends can be fairly easy when the speed of the machine is uniform. The problem arises when the machine is starting up and it is important that as few rejects be formed as possible.

It can be seen that the invention is an improved version of the apparatus and its operation as set forth in U.S. Pat. No. 4,832,744 and U.S. patent application Ser. No. 454,486, cited above.

In order to control the movement of the containers through the label applying system, the containers are positively held from above against the conveyor belt until they become in the grasp of the label applying arms. Once the label is in place, the heat seal bar will contact the overlap of the label positively. When the heat seal has been completed, the container again is biased against the conveyor by an overhead moving belt until such time as the container is engaged by the set of exit belts.

Figure 5:
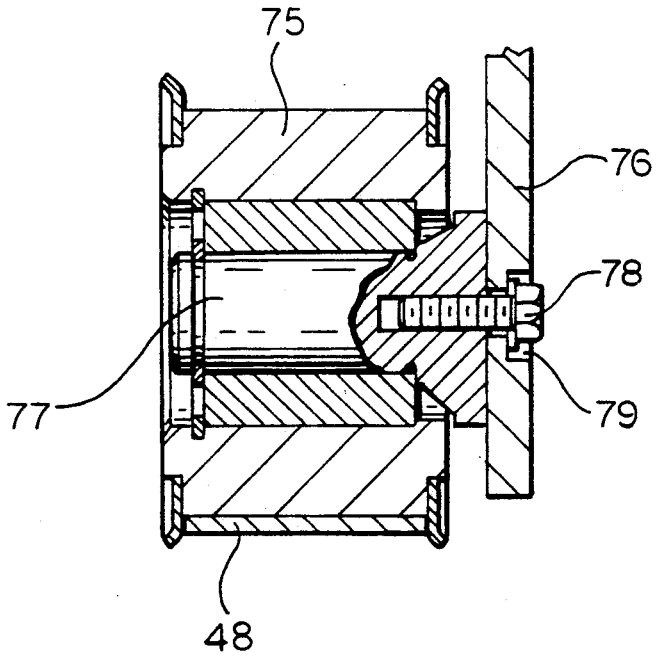
FIG. 5 is a cross-sectional view on an enlarged scale, taken at line 5—5 of FIG. 2.

One important aspect of the hold down belt system for the containers at the exit end of the machine is that it be capable of adjustment as to the point where the biasing belt engages and disengages the container necks. This is also a consideration for the positioning of the hold-down belt at the entrance end of the machine. Adjustment is provided by the manner in which the lower run of the belts can be adjusted with the mechanism illustrated in FIG. 5. The idler pulleys 33 and 34 at the incoming end and pulleys 74, 75 at the exit ends of the machine are mounted to their mounting plates 38 and 76 respectively, as illustrated in FIG. 5. The guide pulley 75 over which the belt 48 passes is mounted for rotation about a stub shaft 77. The shaft 77 is bolted to plate 76 by a bolt 78 extending through a horizontal slot 79. The pulleys 74, 75, 33 and 34 may be moved along their mounting slots to provide a convenient means of adjusting the length of the hold-down period at both the incoming and exiting end of the label applicating machine. This adjustment can be carried out while the machine is in operation to provide a fine adjustment of the timing of the periods.

Other modifications may be apparent to those skilled in the art without departing from the invention as set forth in the following claims.

What is claimed:

1. In combination with an apparatus for applying foam or film plastic labels to a plurality of containers moving on a conveyor, with means spacing the plurality of containers supported on said conveyor, a plurality of label supporting heads with means for supporting and moving said heads in a continuous path at spaced intervals corresponding to the spacing of containers where said continuous path has a portion that parallels the conveyor at one side thereof, with means carried by said heads for engaging the ends of a label supported by said head and for moving the ends of the label into surrounding and overlapping relationship with respect to a container on said conveyor, with a plurality of heat-sealing bars, with means for supporting said bars for horizontal movement in an endless path where a portion of the path is parallel to the conveyor movement with said bars being supported at spaced intervals that correspond to the spacing of the containers on the conveyor with means carried by the bar supports for reciprocating the bars into engagement with the overlapped ends of a label: the improvement wherein the upper surface of said conveyor is offset from the line of movement of the containers supported thereby such that bottoms of the containers at the side facing the heat bars extend beyond the edge of the conveyor, biasing means mounted above the conveyor for engaging the tops of the containers and biasing the containers against the top of the conveyor, and wherein each said heat seal bar support further includes a spring biased finger carried thereby extending outwardly of the bar and movable with the bar to engage the outer surface of the label end that overlaps the other end to assure that the bar will engage the outer surface at the proper position to effect a heat seal seam.

2. In combination with an apparatus for applying foam or film plastic labels to a plurality of containers moving on a conveyor, with means for spacing the plurality of containers supported on said conveyor, a plurality of label supporting heads with means for supporting and moving said heads in a continuous path at spaced intervals corresponding to the spacing of containers where said continuous path has a portion that parallels the conveyor at one side thereof, with means carried by said heads for engaging the ends of a label supported by said head and for moving the ends of the label into surrounding and overlapping relationship with respect to a container on said conveyor, with a plurality of heat-sealing bars, means for supporting said bars for horizontal movement in an endless path where a portion of the path is parallel to the conveyor movement with said bars being supported at spaced intervals that correspond to the spacing of the containers on the conveyor with means carried by the bar supports for reciprocating the bars into engagement with the overlapped ends of the label: the improvement wherein the upper surface of said conveyor is offset from the line of movement of the containers supported thereby such that the bottoms of the containers at the side facing the heat bars extend beyond the edge of the conveyor, biasing means mounted above the conveyor for engaging the tops of the containers and biasing the containers against the top of the moving conveyor, and wherein each said heat seal bar extends below the plane of the bottom of the container, and said bar supports an electrical resistance heater element along its entire length, said resistance heater having a heat pattern such that the heat applied to the overlap area of the label is uniform throughout its length to assure a complete vertical heat seal without overheating any portion thereof.

* * * * *